US010299644B2

(12) United States Patent
Genn et al.

(10) Patent No.: US 10,299,644 B2
(45) Date of Patent: May 28, 2019

(54) CLEANER HEAD

(71) Applicant: Dyson Technology Limited, Wiltshire (GB)

(72) Inventors: Stuart Lloyd Genn, Swindon (GB); Ashley James Hribar-Green, Bristol (GB); Matthew Jonathan Stubbs, Newport (GB); Robert Michael Cox, Warwick (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 279 days.

(21) Appl. No.: 15/271,992

(22) Filed: Sep. 21, 2016

(65) Prior Publication Data

US 2017/0079493 A1 Mar. 23, 2017

(30) Foreign Application Priority Data

Sep. 21, 2015 (GB) ..... 1516647.3

(51) Int. Cl.

| | |
|---|---|
| ***A47L 9/04*** | (2006.01) |
| ***A47L 5/30*** | (2006.01) |
| ***A47L 9/16*** | (2006.01) |
| ***A47L 9/00*** | (2006.01) |
| ***A47L 9/02*** | (2006.01) |
| ***A47L 9/06*** | (2006.01) |

(52) U.S. Cl.

CPC ..... *A47L 9/0477* (2013.01); *A47L 5/30* (2013.01); *A47L 9/009* (2013.01); *A47L 9/02* (2013.01); *A47L 9/04* (2013.01); *A47L 9/0411* (2013.01); *A47L 9/06* (2013.01); *A47L 9/1683* (2013.01)

(58) Field of Classification Search

CPC ..... C07K 5/06078; A47L 5/30; A47L 9/009; A47L 9/02; A47L 9/04; A47L 9/0411; A47L 9/0477; A47L 9/06; A47L 9/1683

See application file for complete search history.

(56) References Cited

U.S. PATENT DOCUMENTS

| | | | | |
|---|---|---|---|---|
| 2,511,238 A | | 6/1950 | Beede | |
| 2,517,058 A | | 8/1950 | Uber | |
| 4,864,682 A | * | 9/1989 | Bewley, Jr. | A47L 5/34 15/364 |

(Continued)

FOREIGN PATENT DOCUMENTS

| | | |
|---|---|---|
| CN | 204016185 | 12/2014 |
| DE | 1 960 386 | 5/1967 |

(Continued)

OTHER PUBLICATIONS

Search Report dated Mar. 23, 2016, directed to GB Application No. 1516647.3; 1 page.

(Continued)

*Primary Examiner* — Marc Carlson

(74) *Attorney, Agent, or Firm* — Morrison & Foerster LLP

(57) ABSTRACT

A cleaner head including a cleaner head body, a sole plate including a rear portion and flexible lateral side portions that define at least part of the periphery of a dirty air opening. The rear portion and the flexible lateral side portions are movable relative to the cleaner head body such that, in use, the rear portion and the flexible lateral side portions conform to a surface being cleaned in order to maintain a seal between the cleaner head and the surface.

28 Claims, 6 Drawing Sheets

(56) References Cited

U.S. PATENT DOCUMENTS

| | | | | |
|---|---|---|---|---|
| 6,266,846 | B1 | 7/2001 | Chan | |
| 7,334,284 | B2 | 2/2008 | Grey | |
| 8,555,462 | B2 * | 10/2013 | Maguire | A47L 9/0411 15/358 |
| 9,451,856 | B2 * | 9/2016 | Gray | A47L 9/02 |
| 2010/0236019 | A1 | 9/2010 | Behrenswerth | |
| 2010/0257693 | A1 * | 10/2010 | Sweeby | A47L 5/30 15/389 |
| 2010/0257695 | A1 * | 10/2010 | Maguire | A47L 9/009 15/415.1 |
| 2010/0257696 | A1 * | 10/2010 | Maguire | A47L 9/06 15/415.1 |
| 2011/0239397 | A1 * | 10/2011 | Dekkers | A47L 9/0072 15/319 |
| 2012/0124769 | A1 * | 5/2012 | Krebs | A47L 5/34 15/319 |
| 2013/0145577 | A1 * | 6/2013 | Davidshofer | A47L 5/30 15/383 |
| 2013/0174372 | A1 | 7/2013 | Guder et al. | |
| 2015/0135477 | A1 | 5/2015 | Davidshofer et al. | |
| 2016/0270610 | A1 * | 9/2016 | Kasper | A47L 5/34 |

FOREIGN PATENT DOCUMENTS

| | | |
|---|---|---|
| DE | 199 00 557 | 7/2000 |
| DE | 201 18 711 | 4/2002 |
| EP | 0 304 609 | 3/1989 |
| EP | 2 152 135 | 12/2011 |
| GB | 2 109 224 | 6/1983 |
| GB | 2484146 | 2/2013 |
| JP | 61-217126 | 9/1986 |
| JP | 62-112558 | 7/1987 |
| JP | 3903308 | 4/2007 |
| JP | 2013-141611 | 7/2013 |
| KR | 10-0652488 | 12/2006 |

OTHER PUBLICATIONS

International Search Report and Written Opinion dated Nov. 7, 2016, directed to International Application No. PCT/GB2016/052613; 10 pages.

* cited by examiner

CLEANER HEAD

REFERENCE TO RELATED APPLICATIONS

This application claims the priority of United Kingdom Application No. 1516647.3, filed Sep. 21, 2015, the entire contents of which are incorporated herein by reference.

FIELD OF THE INVENTION

This invention relates to a cleaner head and a vacuum cleaner comprising a cleaner head.

BACKGROUND OF THE INVENTION

GB2484146B discloses a stick vacuum cleaner comprising a handheld vacuum cleaner to which a wand and a cleaner head are attached. As the cleaner head is pushed back and forth across the floor during use, the force exerted by the user on the vacuum cleaner, and hence the cleaner head, fluctuates.

For example, on a forward stroke, the user exerts a pushing force on the stick vacuum cleaner. The wheels on the neck of the floor tool are therefore pressed against the surface being cleaned. For carpeted surfaces, the wheels on the neck of the cleaner head are pushed downwardly into the carpet pile. The effect is that the relatively buoyant forward part of the cleaner head and the soleplate tilts upwardly; reducing penetration of the brushbar into the carpet, which reduces cleaning effectiveness.

Conversely, on a rearward stroke, the user exerts a pulling force on the stick vacuum cleaner. Typically, a user will pull in an upward and rearward direction, which can, in some circumstances, lift the wheels on the neck of the cleaner head and the soleplate away from the surface being cleaned thereby reducing the effectiveness of the seal between the cleaner head and the surface. The reduction in the partial vacuum generated within the cleaner head which is caused by lifting of the soleplate from the floor produces a deterioration in pick up performance.

SUMMARY OF THE INVENTION

According to a first aspect of the present invention there is provided a cleaner head comprising a cleaner head body, a sole plate comprising a rear portion and flexible lateral side portions that define at least part of the periphery of the dirty air opening, the rear portion and the flexible lateral side portions being movable relative to the cleaner head body such that, in use, the rear portion and the flexible lateral side portions conform to a surface being cleaned in order to maintain a seal between the cleaner head and the surface being cleaned.

An advantage of the invention is that a static pressure within the cleaner head body is maintained at a pressure below ambient static pressure as the cleaner head is moved across an undulating surface or when the rear of the cleaner head is lifted from the surface because the rear portion and the flexible lateral side portions of the sole plate adapt the surface in order to maintain a seal against the surface. The term "seal" means a restriction/occlusion of a gap between the cleaner head and a surface being cleaned is sufficient to maintain the static pressure within the cleaner head body is at least 1 kPa below ambient static pressure during normal use.

The rear portion may comprise a lower sealing surface that, in use, seals against a surface being cleaned. The rear portion may be pivotally connected to the cleaner head body. The rear portion may, as an alternative, be connected to the cleaner head body such that the rear portion is cantilevered with respect to the cleaner head body. The rear portion may be arranged in a trailing configuration in which the rear portion extends rearwardly from the connection between the rear portion and the cleaner head body. The rear portion may comprise a rigid portion and a flexible portion. The rear portion may be connected to the cleaner head body by the flexible portion. The flexible portion may comprise a resilient material, such as an elastomeric material. Should the rear portion be pivotally connected to the cleaner head body, the whole of the rear portion may be rigid.

Each lateral side portion may extend forwardly of the rear portion. For example, each lateral side portion may extend from the a rear edge of the rear the rear portion along to a region forward of the rear portion that may be at least midway along the side of the cleaner head. Each lateral side portion may be connected to the cleaner head body such that the side portion is cantilevered with respect to the cleaner head body. Each lateral side portion is arranged in a trailing configuration in which the lateral side portion extends rearwardly from the connection between the lateral side portion and the cleaner head body. The side portions may comprise a resilient material, such as an elastomeric material. At least part of each lateral side portion extends downwardly from the rear portion so as to occlude any gaps between lateral edges of the rear portion and a surface being cleaned. Each lateral side portion may have a lower sealing surface that extends forwardly from a lowermost part of the rear portion.

The cleaner head may further comprise a support which is arranged to support the cleaner head on the surface being cleaned. The support may comprise at least one wheel. A lower periphery of the support, or the lower peripheries of several supports such as front and rear supports, may define a floor contact plane. The floor contact plane is plane on which the cleaner head is supported by the support or supports during normal use.

The lower sealing surface may have a front edge and a rear edge. The rear portion may have a first position in which the rear edge extends in the floor contact plane and a second position in which the rear edge is below the floor contact plane such that the sealing surface extends in a rearward and downward direction from the front edge with respect to the floor contact plane.

In the first position, the front edge may be above the floor contact plane such that the sealing surface extends in a rearward and downward direction from the front edge with respect to the floor contact plane.

The rear portion may have a third position in which the rear edge is above the floor contact plane such that the lower sealing surface extends in a rearward and upward direction from the front edge with respect the floor contact plane.

The sole plate may further comprise a front portion that defines at least part of the periphery of the dirty air opening, wherein the rear portion is movable relative to the cleaner head body independently of the front portion.

The front portion may have a lower surface for sealing against a surface being cleaned, the lower surface is inclined upwardly with respect to the floor contact plane in a rearward direction.

The rear portion may comprise an upper surface that, in use, is exposed to ambient pressure.

The rear portion may be arranged such that, during use and when the rear portion is in the second position, a net pressure acting on the upper surface presses the rear portion against the surface being cleaned.

The rear portion may comprise a lip that extends along at least part of the rear portion. The lip may have a lower surface that extends upwardly and rearwardly with respect to the lower sealing surface of the rear portion. The lip may comprise a resilient material, such as an elastomeric material.

According to a second aspect of the invention there is provided a floor tool comprising a cleaner head in accordance with the first aspect of the invention.

According to a third aspect of the invention there may be provided a vacuum cleaner comprising a cleaner head in accordance with the first aspect of the invention.

BRIEF DESCRIPTION OF THE DRAWINGS

In order to better understand the present invention, and to show more clearly how the invention may be put into effect, the invention will now be described, by way of example, with reference to the following drawings.

DETAILED DESCRIPTION

Figure 1:
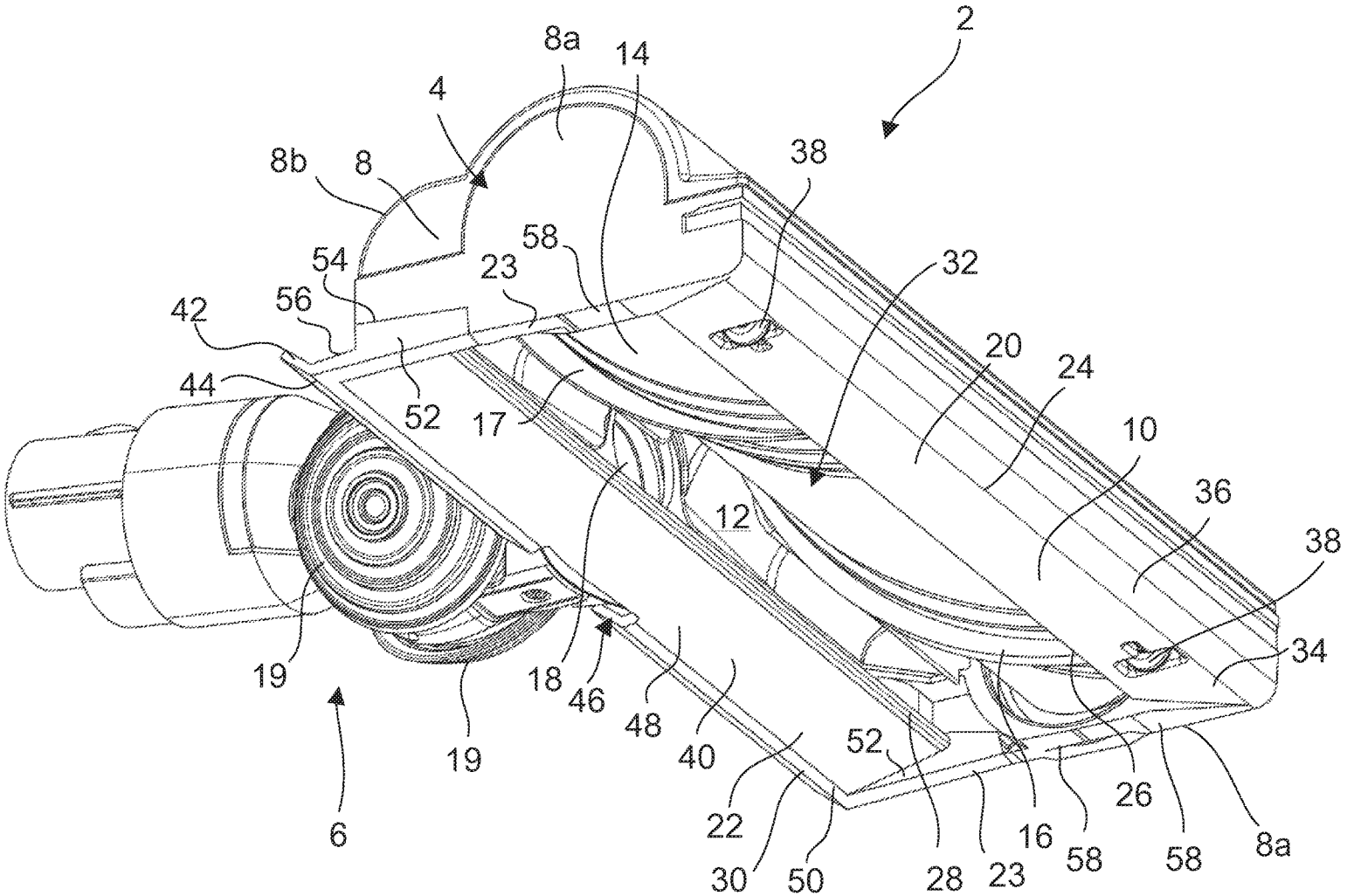
FIG. 1 is a perspective view of a cleaner head from below.

FIG. 1 shows a floor tool 2 comprising a cleaner head 4 and an articulated neck 6 which is rotatably connected to the cleaner head 4.

The cleaner head 4 comprises a cleaner head body 8 and a soleplate 10. The cleaner head body 8 has opposing side portions 8*a* and a cover 8*b* that together define a chamber 12 in which an agitator in the form of a brushbar 14 is disposed. The brushbar 14 comprises bristles 16, 17 that are arranged in strips which extend about the brushbar 14. The bristles 16, 17 project radially outwardly from the brushbar 14 and comprise a first strip of Nylon bristles 16 and a second strip of carbon fibre bristles 17. The brushbar 14 is mounted to the cleaner head body 8 such that it can rotate with respect to the cleaner head body 8. The brushbar 14 is driven by a motor (not shown) disposed within the brushbar 14. The chamber 12 has an outlet 18 which is in fluid communication with the neck 6. The articulated neck 6 comprises a rear wheel 19 on each side of the neck 6 for supporting the floor tool 2 during use.

The soleplate 10 comprises a front portion 20, a rear portion 22 and side portions 23. The front portion 20 is formed integrally with the cleaner head body 8, although it will be appreciated that in an alternative embodiment the front portion 20 could be a separate component secured to the cleaner head body 8. The front portion 20 has a front edge 24 and a rear edge 26 that extend transversely with respect to the cleaner head 4. The rear portion 22 has a front edge 28 and a rear edge 30 that extend transversely with respect to the cleaner head 4 in a plane A. The rear edge 26 of the front portion 20 and the front edge 28 of the rear portion 22 form respective forward and rearward edges of a dirty air opening 32. The dirty air opening 32 extends in plane A (illustrated in FIG. 3) and is partly defined by the side portions 8*a* of the cleaner head body 8 and the side portions 23 of the soleplate 10.

The front portion 20 has a front sealing surface 34 which forms a lower surface of the cleaner head 4 on the underside of the cleaner head 4. The front sealing surface 34 extends from the front edge 24 to the rear edge 26 of the front portion 20. The front sealing surface 34 is planar and extends from the front edge 24 in an upward and rearward direction. The front edge 24 defines the lowermost part of the front portion 20. The front portion 20 further comprises a curved surface 36 that curves upwardly from the front edge 24 to the front of the cleaner head 4. It will be appreciated that the curved surface 36 is blended with the front sealing surface 34. The front edge 24 is therefore the lowermost region at the interface between the two surfaces.

Two front wheels 38 are secured to the front portion 20. Each wheel 38 is recessed into the front sealing surface 34 such that part of the wheel 38 protrudes from the front portion 20. Each wheel 38 projects by a distance which ensures that when the floor tool 2 is placed on a hard surface, the wheels 38 maintain a small gap between the hard surface and the front edge 24. The gap is between 1 mm and 5 mm.

The rear wheels 19 on each side of the neck 6 together with the front wheels 38 secured to the front portion 20 support the cleaner head 4 on a surface during use. The lower periphery of the front and rear wheels 38, 19 define a floor contact plane FP of the cleaner head 4.

The rear portion 22 has a rear sealing surface 40 which forms a lower surface of the cleaner head 4 on the underside of the cleaner head 4. The rear sealing surface 40 extends from the front edge 28 to the rear edge 30 of the rear portion 22. The rear portion 22 also has a lip 42 that extends along the rear edge 30 of the rear portion 22. The lip 42 has a lower surface 44 that extends away from the rear edge 30 in a rearward and upward direction. The lower surface 44 of the lip 42 is planar and inclined with respect to the rear sealing surface 40. The lip 42 ensures that the rear portion 22 rides smoothly over a surface being cleaned on a rearward stroke and so does not dig into the surface. A central slot 46 is provided at the rear of the rear portion 22. The slot 46 is configured to accommodate the neck 6.

In the embodiment shown, the rear portion 22 comprises a rigid plate 48 and a frame 50 made from an elastomeric material. The frame 50 extends around the periphery of the plate 48 such that it defines the front and rear edges 28, 30 of the rear portion 22, the lip 42 and side portions 52. The side portions 52 form part of the side portions 23 of the sole plate 10. The frame 50 is preferably made from an elastomeric material having a Shore hardness of between 30'A' and 50'A', for example 40'A'. The frame 50 may, for example be made of a thermoplastic polyurethane (TPU). The frame 50 is secured to the cleaner head body 8 such that the rear portion 22 can flex about the front edge 28. The rear portion 22 is therefore connected to the cleaner head body 8 in a trailing configuration such that the rear portion 22 is movable relative to the cleaner head body 8 about the front edge 28.

The cleaner head body 8 has a downwardly facing abutment surface 54 at each end of the cleaner head 4 and positioned directly above the rear portion 22. Each abutment surface 54 is inclined with respect to the floor contact plane FP. The side portions 52 are secured, for example by gluing or welding, in abutting engagement with a respective abutment surface 54. Each side portion 52 resists upward displacement of the rigid plate 48 thereby limiting the range of rotation of the rigid plate 48 in the upward direction. In addition, the rear portion 22 has an upper surface 56 formed by an upper surface of the rigid plate 48 and an upper surface of the frame 50 which, during use, is exposed to ambient pressure. The rear portion 22 is arranged such that, in use, when the rear rigid plate 48 is inclined rearwardly and downwardly, a pressure difference can be maintained between the ambient pressure acting on the upper surface 56 and the partial vacuum within the chamber 12 which acts on the rear sealing surface 40 on the underside of the rear portion 22.

The side portions 8*a* of the cleaner head body 8 and the side portions 52 of the frame 50 define respective lower sealing surfaces 58 of the side portions 23 of the sole plate 10 which extend along each lateral side of the cleaner head 4. Each sealing surface 58 extends from the front edge 24 of the front portion 20 to the rear edge 30 of the rear portion 22 in the plane in which both the front edge 24 and the rear edge 30 extend.

Figure 4:
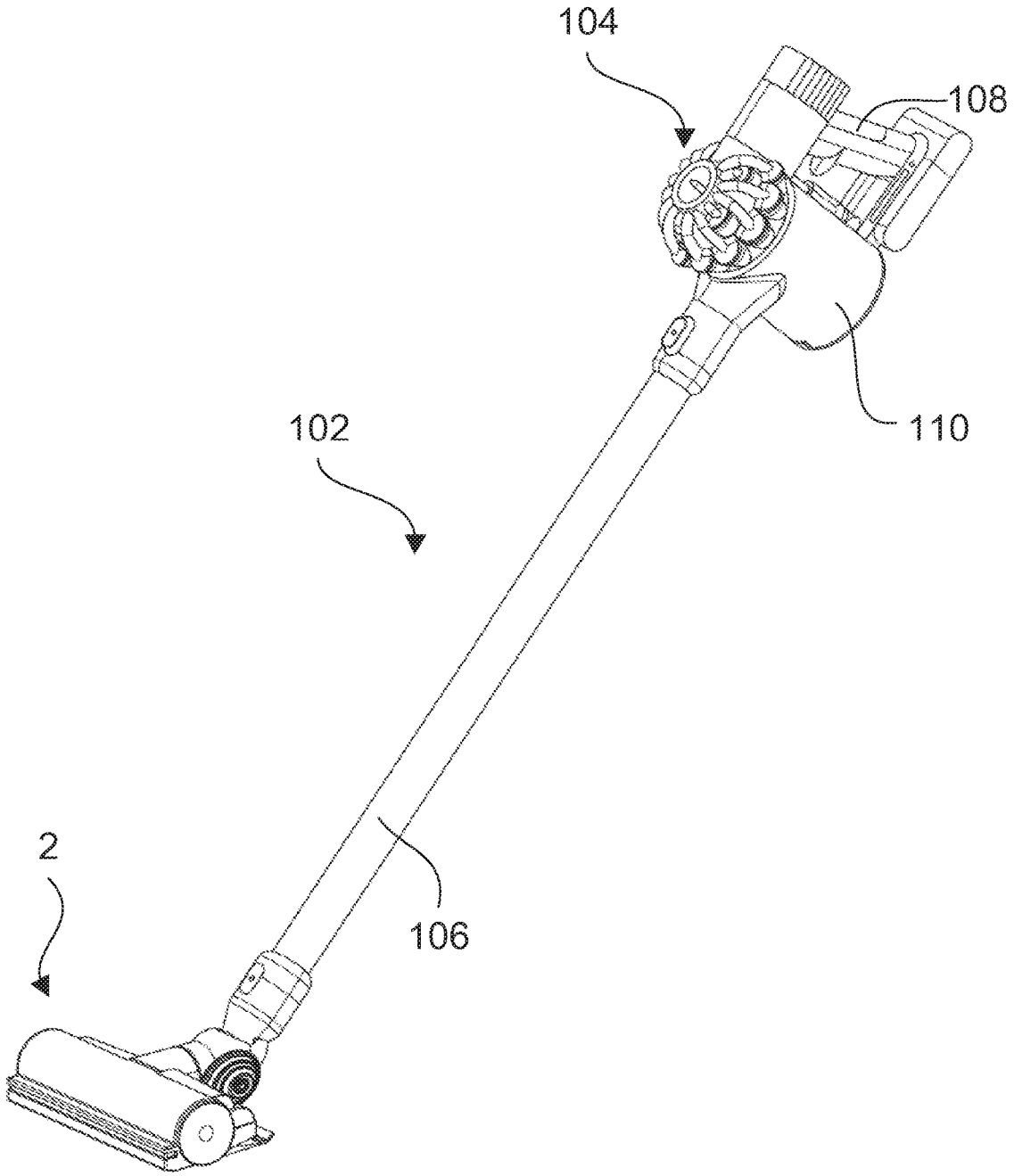
FIG. 4 shows a vacuum cleaner comprising the cleaner head shown in FIG. 1.

FIG. 4 shows a stick vacuum cleaner 102 comprising a handheld unit 104, a wand 106 and the floor tool 2 shown in FIG. 1. The handheld unit 104 comprises a suction generator (not shown), comprising a motor and fan unit, a handle 108 and a separator 110 for separating dirt from an airflow.

In use, air and dirt are drawn by the suction generator through the dirty air opening 32 of the floor tool 2 into the chamber 12, and from the chamber 12 through the outlet 18, neck 6, wand 106 and into the separator 110. Dirt entrained by the air is separated from the air flow by the separator 110 before being expelled by the from the handheld unit 104. In the embodiment shown, the separator 110 is a cyclonic separator. The brushbar 14 is driven in a clockwise direction, as shown in FIG. 3, such that debris is swept rearwardly by the brushbar 14 towards the outlet 18.

Figure 2:
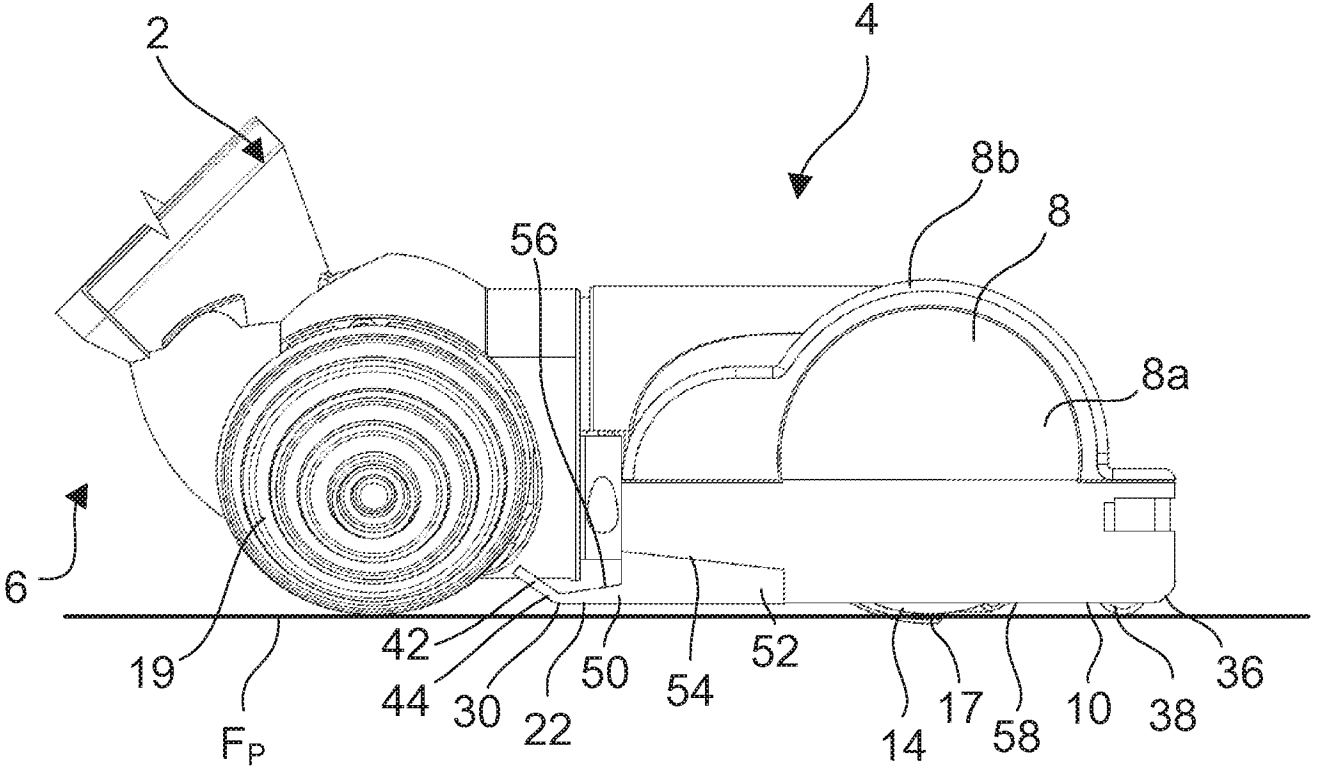
FIG. 2 is a side view of the cleaner head shown in FIG. 1.
Figure 3:
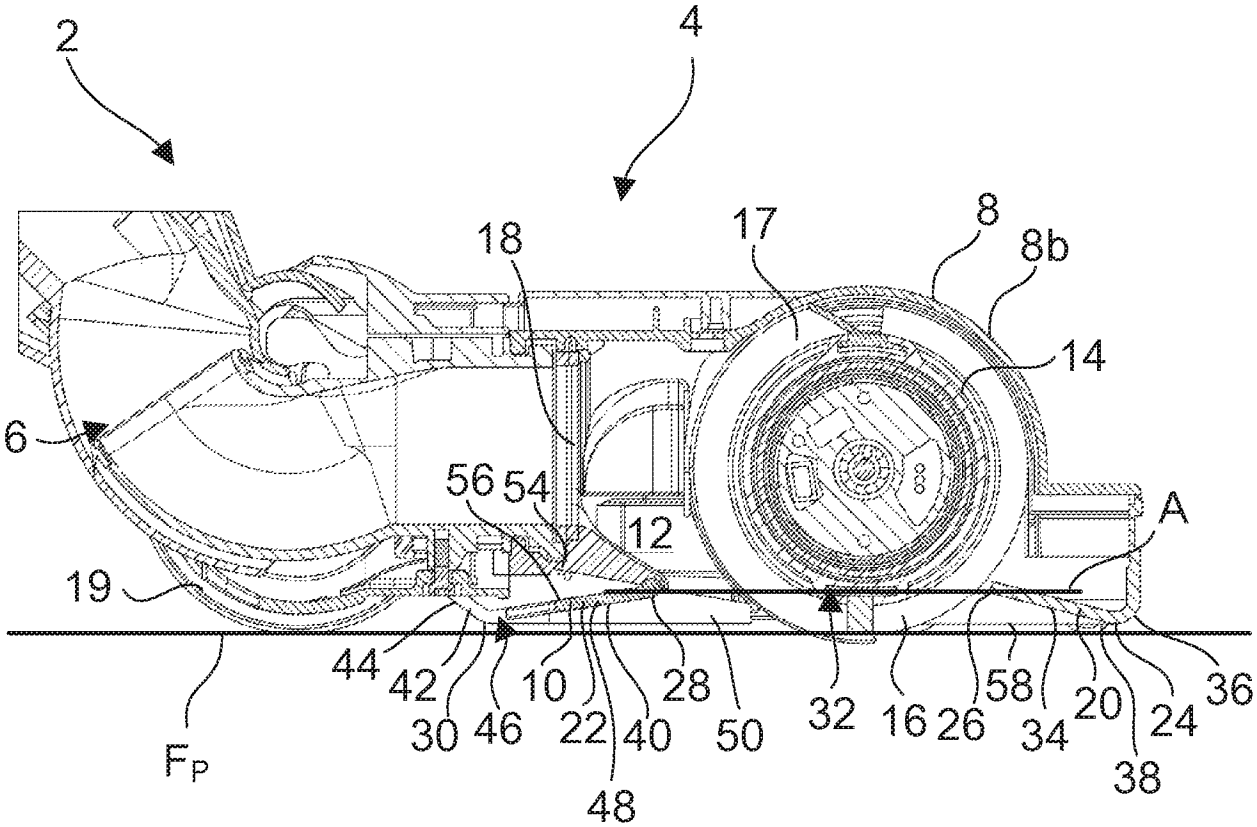
FIG. 3 is a sectional view of the cleaner head shown in FIG. 1.
Figure 5A:
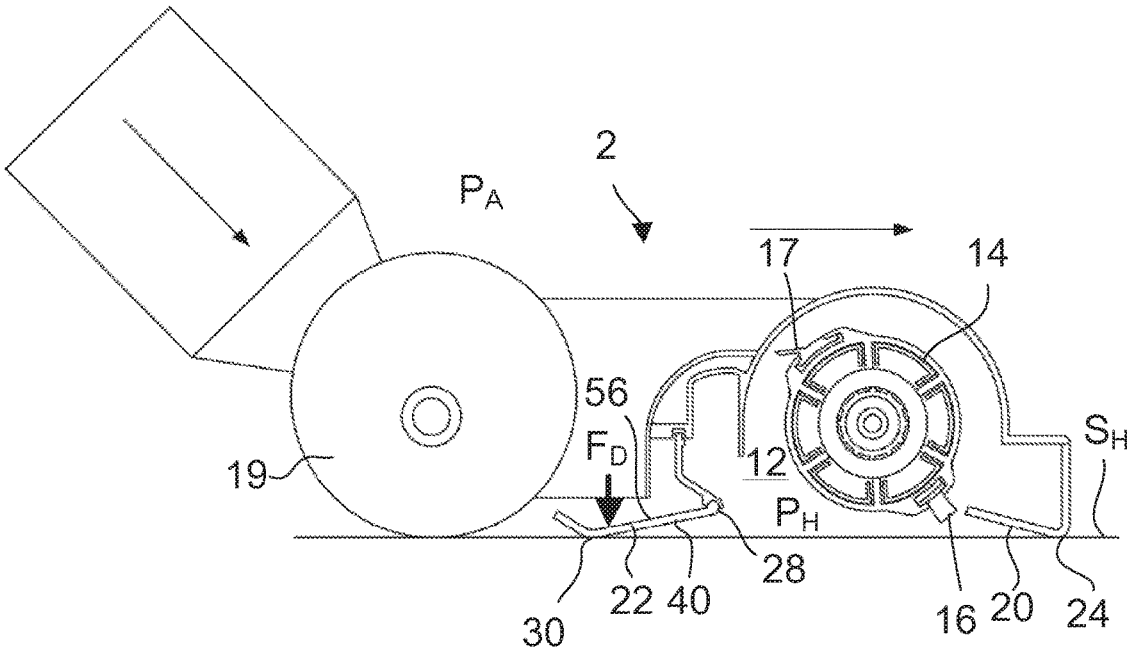
FIGS. 5A and 5B are schematic representations of the cleaner head shown in FIG. 1 during use on a hard flat surface.

FIG. 5A is a schematic representation of the floor tool shown in FIGS. 1 to 3 when placed on a hard flat surface SH. The floor tool 2 is supported on the surface by the front and rear wheels 38, 19 (only the rear wheels are shown). The frame 50 is arranged such that the side portions 52 are slightly compressed against the abutment surfaces 54 when the floor tool 2 is placed on a hard flat surface. The rear edge 30 is therefore pressed lightly against the surface SH by the side portions 52 such that the rear edge 30 forms a seal against the surface SH. The lower sealing surfaces 58 flex in order to conform to the flat surface and so minimise the gap between the side portions 52 and the surface SH. The effective sealing between the rear portion 22 and the surface SH ensures a partial vacuum can be maintained within the chamber 12 that improves pick-up performance. For example, a partial vacuum PH of between 1 kPa and 10 kPa below ambient static pressure PA (i.e. atmospheric pressure), preferably between 1 kPa and 4 kPa below ambient static pressure PA, is maintained during use of the vacuum cleaner 102. However, since only the rear edge 30 contacts the surface SH and not the entire rear sealing surface 40, excessive sealing is avoided and so the pushing force required to manoeuvre the cleaner head 2 across the surface SH is not excessive.

The difference between the ambient static pressure PA acting on the upper surface 56 of the rear portion 22 and the partial vacuum PH within the chamber 12, which acts on the rear sealing surface 40, produces a net downward force FD on the upper surface 56 of the rear portion 22 which contributes to the overall force pressing the rear edge 30 against the surface SH. The resilience of the side portions 52 of the frame 50 combined with the net pressure acting on the upper surface 56 is sufficient to maintain a seal between the rear edge 30 and the surface SH, while limiting the pushing force required to manoeuvre the cleaner head 4 across the surface SH. Forward of the rear edge 30, a small gap (not shown) is formed between the forward regions of the lower sealing surfaces 58 and the hard surface SH. The gap provides a relatively low-flow path that prevents the sole plate 10 from limpetting (i.e. sticking) against the surface SH, but does not prevent a partial vacuum from being maintained within the chamber 12. The carbon fibre bristles 17 of the brushbar 14 sweep through the floor contact plane FP as the brushbar 14 is rotated and so sweep the surface SH. In contrast, the stiffer Nylon bristles 16 are held out of contact with the surface SH and so scratching of the surface SH is prevented.

Throughout a forward stroke, the front and rear wheels 38, 19 are pushed against the surface SH. The wheels 38, 19 prevent the cleaner head body 8 from being pressed hard against the surface SH and maintain the gap between the surface SH and the front edge 24 and also the forward regions of the lower sealing surfaces 58.

Figure 5B:
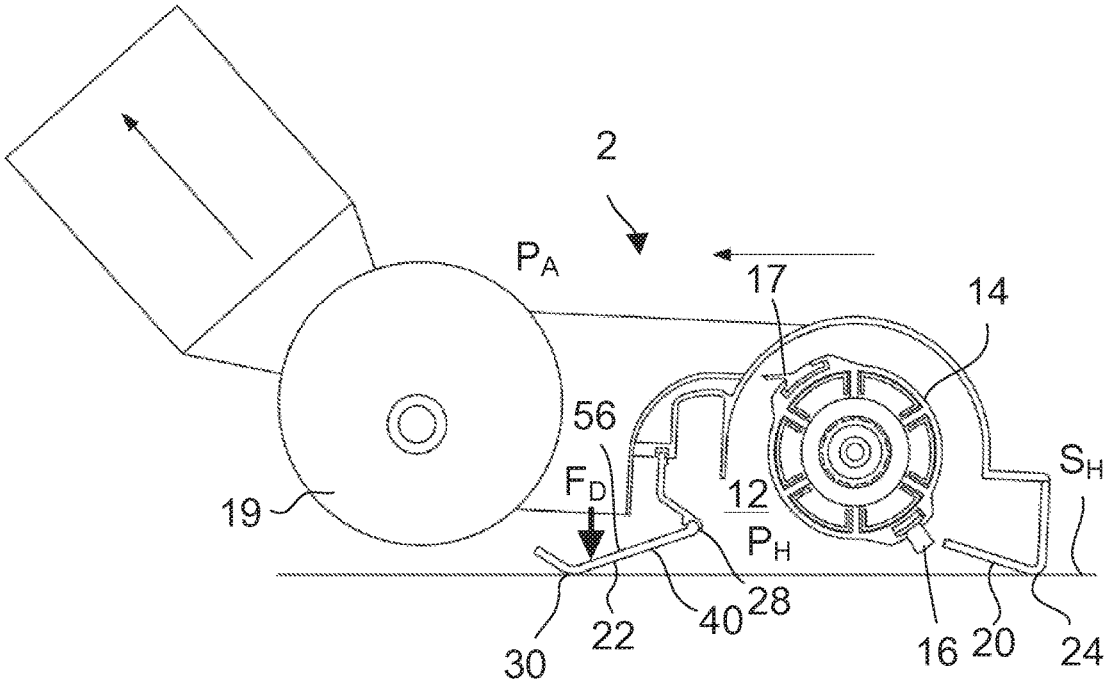

On a rearward stroke, the tendency of a user to pull upwardly causes the rear wheels 19 and rear portion of the cleaner head body 8 to lift away from away from the surface SH, as shown in FIG. 5B. As the rear of the cleaner head body 8 lifts away from the surface SH, the downward force FD caused by the net pressure on the upper surface 56 and by the side portions 52 holds the rear edge 30 against the surface SH thereby maintaining the seal between the rear portion 22 and the surface SH. The inclination angle of lower sealing surface 40 of the rear portion 22 with respect to the floor contact plane FP increases, and the side portions 52 flex downwardly in an arc towards the surface SH. Maintaining contact between the rear edge 30 and the surface SH on the rearward stroke ensures that the desired partial vacuum can be maintained within the chamber 12.

Figure 6A:
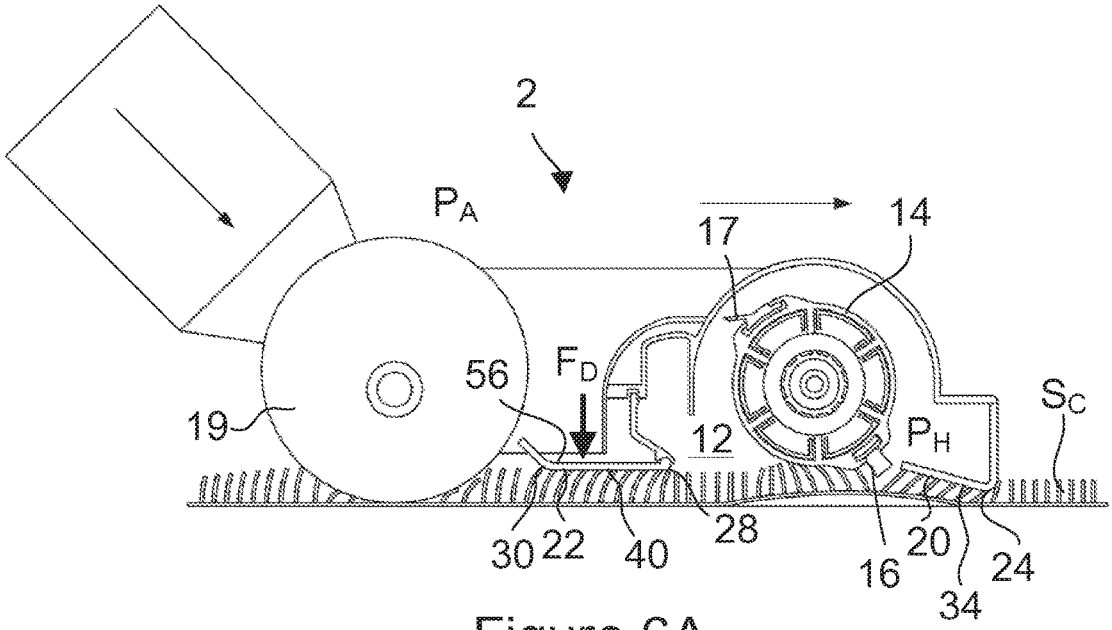
FIGS. 6A and 6B are schematic representations of the cleaner head shown in FIG. 1 during use on a carpeted surface.

When the cleaner head 4 is placed on a carpet SC, as shown in FIG. 6A, the front and rear wheels 38, 19 (only the rear wheels are shown) sink into the fibres of the carpet. The fibres of the carpet press the rear portion 22 upwardly. The force of the fibres against the rear portion 22 is typically sufficient to overcome the combined force of the side portions 52 and the pressure acting on the upper surface 56 of the rear portion 22 such that the rear portion 22 swings upwardly. In such a configuration, the rear edge 30 of the rear portion 22 is raised level with or above the front edge 28 of the rear portion 22, and the whole of the rear sealing surface 40 is pressed against the carpet fibres.

Rotation of the rear portion 22 upwardly allows the bristles 16, 17 of the brushbar 14 to penetrate deep into the carpet fibres, which improves cleaning effectiveness. In particular, the Nylon bristles, which are in clearance from the surface being cleaned when the floor tool 2 is used on a hard flat surface, are brought into engagement with the carpet and can penetrate deep into the carpet fibres. Typically, for example when used the cleaner head 4 is used on relatively short-pile carpets, the amount of force exerted by the rear portion 22 on the carpeted surface is limited to that transmitted by the side portions 52. Consequently, the force required to push the cleaner head 4 across the carpet SC is relatively low compared with conventional floor tools.

On a forward stoke, the front and rear wheels 38, 19 limit the amount by which the soleplate 10 can be pressed against the carpet SC and so the partial vacuum within the chamber 12, and the pushing force required to manoeuvre the cleaner head 4 across the carpet SC remains substantially constant.

Displacement of the rear portion 22 ensures that the floor tool 2 does not pivot about the rear edge 30 and tilt upwardly.

Figure 6B:
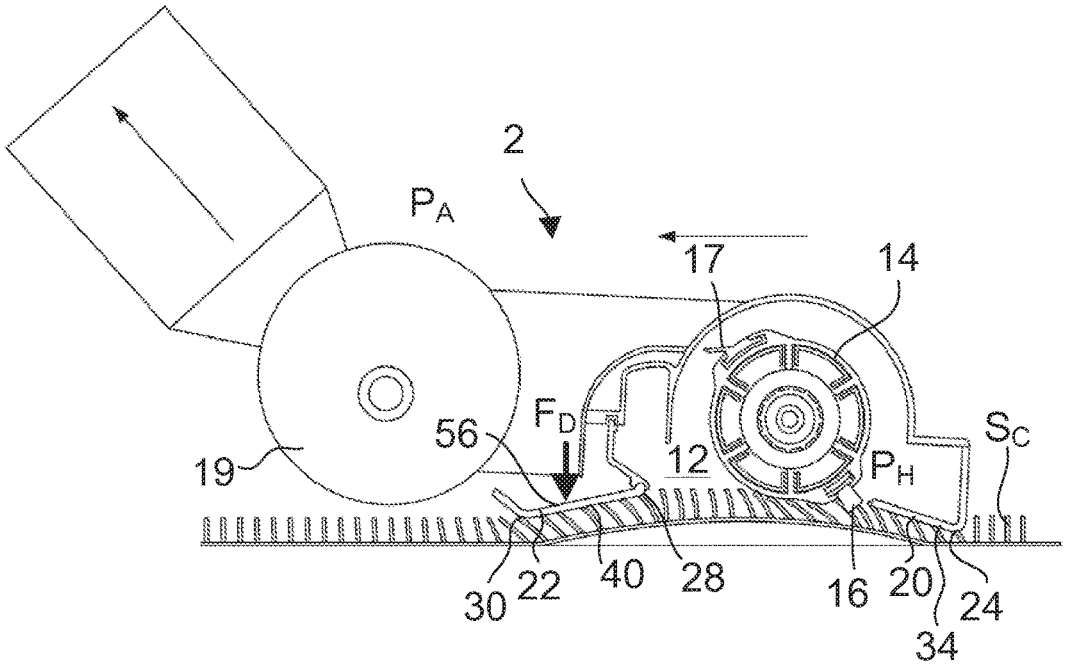

On a rearward stroke, as the rear wheels 19 and the rear portion of the cleaner head body 8 are lifted away from the carpet SC, the rear portion 22 rotates downwardly and so maintains a seal against the carpet SC, but can continue to conform to the topography of the carpet(as shown in FIG. 6B). The rigid plate 48 provides stiffness in the forward/rearward direction so as to prevent the rear portion 22 from folding back underneath itself on the rearward stroke.

The arrangement described above is particularly beneficial when the cleaner head 4 is used on a carpet or matting that is not fully bonded to the surface SH. In such circumstances, the partial vacuum within the chamber 12 can cause the carpet to billow up through the dirty air opening 32 into the chamber 12, as shown in FIG. 6B. In response, the rear portion 22 rotates downwardly and the side portions 52 deform in order to conform to the shape of the carpet. Consequently, the entirety of the rear sealing surface 40 and lower sealing surfaces 58 of the cleaner head 4 are held in sealing contact with the carpet SC. Because the entire rear sealing surface 40 is held in pressing engagement with the carpet, rather than just the rear edge 30 of the rear portion 22, the soleplate 10 provides a good seal against the carpet SC. Similarly, the carpet SC is drawn up against the inclined front sealing surface 34 of the front portion 20 and so a good seal is formed between the front of the cleaner head 4 and the carpet SC. The benefit is apparent for both forward and rearward strokes.

The arrangement is also of benefit to pick-up performance when used on carpets having a non-uniform pile, other compliant surfaces, rug edges, thresholds and undulating surfaces because the rear portion 22 can maintain a good seal against the surface without unduly affecting the pushing force required.

In an alternative embodiment, the rear portion could be fixed to the cleaner head body 8 such that the rear portion is rotatable about a rotational axis that extend parallel with the front edge. In a further embodiment, the rigid plate may be replaced by a plurality of ribs extending in the direction from the front edge to the rear edge of the rear portion and spaced apart in the lateral direction. It is envisaged that such an arrangement would increase the degree of flexibility in the lateral direction, but still prevent the rear portion from folding underneath itself on the rearward stroke.

Although described in the context of use with a stick vacuum cleaner, it will be appreciated that the cleaner head could be used in connection with other types of vacuum cleaners. For example the cleaner head could be incorporated into a floor tool for a cylinder vacuum cleaner, an upright vacuum cleaner or a robotic vacuum cleaner, for which at least some of the advantage described above would be apparent.

The invention claimed is:

1. A cleaner head comprising:

a cleaner head body;

a sole plate comprising a rear portion and flexible lateral side portions that define at least part of the periphery of a dirty air opening, the rear portion and lower surfaces of the flexible lateral side portions being movable relative to the cleaner head body such that, in use, the rear portion and the lower surfaces of the flexible lateral side portions conform to a surface being cleaned in order to maintain a seal between the cleaner head and the surface being cleaned, wherein the lower surfaces of the flexible lateral side portions are formed of a flexible material that contacts the surface to be cleaned when the seal is maintained between the cleaner head and the surface being cleaned.

2. The cleaner head of claim 1, wherein the rear portion comprises a lower sealing surface that, in use, seals against a surface being cleaned.

3. The cleaner head of claim 1, wherein the rear portion is pivotally connected to the cleaner head body.

4. The cleaner head of claim 1, wherein the rear portion is connected to the cleaner head body such that the rear portion is cantilevered with respect to the cleaner head body.

5. The cleaner head of claim 3, wherein the rear portion is arranged in a trailing configuration in which the rear portion extends rearwardly from the connection between the rear portion and the cleaner head body.

6. The cleaner head of claim 3, wherein the rear portion comprises a rigid portion and a flexible portion.

7. The cleaner head of claim 6, wherein the rear portion is connected to the cleaner head body by the flexible portion.

8. The cleaner head of claim 6, wherein the flexible portion comprises a resilient material.

9. The cleaner head of claim 1, wherein each lateral side portion extends forwardly of the rear portion.

10. The cleaner head of claim 1, wherein each lateral side portion is connected to the cleaner head body such that the side portion is cantilevered with respect to the cleaner head body.

11. The cleaner head of claim 10, wherein each lateral side portion is arranged in a trailing configuration in which the lateral side portion extends rearwardly from the connection between the lateral side portion and the cleaner head body.

12. The cleaner head of claim 1, wherein the side portions comprise a resilient material.

13. The cleaner head of claim 1, wherein at least part of each lateral side portion extends downwardly from the rear portion.

14. The cleaner head of claim 13, wherein each lower surface extends forwardly from a lowermost part of the rear portion.

15. The cleaner head of claim 1, wherein the cleaner head further comprises a support which is arranged to support the cleaner head on the surface being cleaned.

16. The cleaner head of claim 15, wherein the support comprises at least one wheel.

17. The cleaner head of claim 15, wherein a lower periphery of the support defines a floor contact plane.

18. The cleaner head of claim 17, wherein the rear portion comprises a lower sealing surface that, in use, seals against a surface being cleaned, and wherein the lower sealing surface has a front edge and a rear edge, the rear portion having a first position in which the rear edge extends in the floor contact plane and a second position in which the rear edge is below the floor contact plane such that the sealing surface extends in a rearward and downward direction from the front edge with respect to the floor contact plane.

19. The cleaner head of claim 18, wherein in the first position, the front edge is above the floor contact plane such that the sealing surface extends in a rearward and downward direction from the front edge with respect to the floor contact plane.

20. The cleaner head of claim 18, wherein the rear portion has a third position in which the rear edge is above the floor contact plane such that the lower sealing surface extends in a rearward and upward direction from the front edge with respect the floor contact plane.

21. The cleaner head of claim 1, wherein the sole plate further comprises a front portion that defines at least part of the periphery of the dirty air opening, wherein the rear portion is movable relative to the cleaner head body independently of the front portion.

22. The cleaner head of claim 21, wherein the front portion has a lower surface for sealing against a surface being cleaned, the lower surface is inclined upwardly with respect to the floor contact plane in a rearward direction.

23. The cleaner head of claim 1, wherein the rear portion comprises an upper surface that, in use, is exposed to ambient pressure.

24. The cleaner head of claim 18, wherein the rear portion is arranged such that, during use and when the rear portion is in the second position, a net pressure acting on the upper surface presses the rear portion against the surface being cleaned.

25. The cleaner head of claim 1, wherein the rear portion comprises a lip that extends along at least part of the rear portion, the lip having a lower surface that extends upwardly and rearwardly with respect to the lower sealing surface of the rear portion.

26. The cleaner head of claim 25, wherein the lip comprises a resilient material.

27. A floor tool comprising a cleaner head, the cleaner head comprising:

a cleaner head body;

a sole plate comprising a rear portion and flexible lateral side portions that define at least part of the periphery of a dirty air opening, the rear portion and lower surfaces of the flexible lateral side portions being movable relative to the cleaner head body such that, in use, the rear portion and the lower surfaces of the flexible lateral side portions conform to a surface being cleaned in order to maintain a seal between the cleaner head and the surface being cleaned, wherein the lower surfaces of the flexible lateral side portions are formed of a flexible material that contacts the surface to be cleaned when the seal is maintained between the cleaner head and the surface being cleaned.

28. A vacuum cleaner comprising a cleaner head, the cleaner head comprising:

a cleaner head body;

a sole plate comprising a rear portion and flexible lateral side portions that define at least part of the periphery of a dirty air opening, the rear portion and lower surfaces of the flexible lateral side portions being movable relative to the cleaner head body such that, in use, the rear portion and the lower surfaces of the flexible lateral side portions conform to a surface being cleaned in order to maintain a seal between the cleaner head and the surface being cleaned, wherein the lower surfaces of the flexible lateral side portions are formed of a flexible material that contacts the surface to be cleaned when the seal is maintained between the cleaner head and the surface being cleaned.

* * * * *